US007390250B2

(12) United States Patent
Reinhardt

(10) Patent No.: US 7,390,250 B2
(45) Date of Patent: Jun. 24, 2008

(54) TEMPORARILY MOUNTABLE STRIP DOOR SYSTEM, ESPECIALLY FOR TEMPORARY CLIMATE CONTROL OF AN AREA

(76) Inventor: Paul Andrew Reinhardt, 12415 Huntingwick, Houston, TX (US) 77024

( * ) Notice: Subject to any disclaimer, the term of this patent is extended or adjusted under 35 U.S.C. 154(b) by 146 days.

(21) Appl. No.: 11/262,368

(22) Filed: Oct. 29, 2005

(65) Prior Publication Data

US 2006/0102297 A1 May 18, 2006

Related U.S. Application Data

(60) Provisional application No. 60/624,244, filed on Nov. 2, 2004, provisional application No. 60/699,298, filed on Jul. 14, 2005.

(51) Int. Cl.

| | |
|---|---|
| ***F24F 13/18*** | (2006.01) |
| ***E06B 3/80*** | (2006.01) |
| ***E06B 3/70*** | (2006.01) |
| ***A47H 1/00*** | (2006.01) |

(52) U.S. Cl. ..... 454/195; 160/184; 160/332

(58) Field of Classification Search ..... 454/195, 454/200, 201, 205, 119, 210; 296/161; 160/126, 160/215, 332, 184

See application file for complete search history.

(56) References Cited

U.S. PATENT DOCUMENTS

| | | | | |
|---|---|---|---|---|
| 1,681,345 | A * | 8/1928 | Johnson | 16/94 D |
| 3,118,363 | A * | 1/1964 | Burgess, Jr. | 454/170 |
| 3,331,425 | A | 7/1967 | Groves | |
| 3,747,503 | A * | 7/1973 | Lovell | 454/170 |
| 3,809,144 | A | 5/1974 | Garufo | |
| 4,139,101 | A * | 2/1979 | Towfigh | 211/107 |
| 4,165,778 | A * | 8/1979 | Smith | 160/332 |
| 4,232,725 | A | 11/1980 | Gidge | |
| 4,289,190 | A * | 9/1981 | Catan | 160/332 |
| 4,382,461 | A * | 5/1983 | Schenker | 160/329 |
| 4,440,070 | A * | 4/1984 | Baker et al. | 454/170 |
| 4,607,678 | A * | 8/1986 | Pomaville et al. | 160/332 |
| 4,770,086 | A * | 9/1988 | Gabster | 454/170 |
| 4,794,974 | A * | 1/1989 | Melino | 160/330 |
| 4,874,028 | A * | 10/1989 | Lynch et al. | 160/332 |
| 5,127,460 | A * | 7/1992 | Abadi et al. | 160/332 |
| 5,146,971 | A * | 9/1992 | McCarty | 160/184 |
| 5,353,601 | A * | 10/1994 | Palmer | 62/171 |
| 5,438,842 | A * | 8/1995 | Watkins et al. | 62/89 |
| 5,887,439 | A * | 3/1999 | Kotliar | 62/78 |
| 5,944,639 | A * | 8/1999 | Ray | 482/87 |
| 6,202,434 | B1 * | 3/2001 | Hearne, Jr. | 62/304 |
| 6,206,077 | B1 * | 3/2001 | Stanfill | 160/174 V |
| 6,402,613 | B1 * | 6/2002 | Teagle | 454/195 |

FOREIGN PATENT DOCUMENTS

| | | | |
|---|---|---|---|
| BE | 814656 A | * | 9/1974 |

* cited by examiner

*Primary Examiner*—Steven B. McAllister
*Assistant Examiner*—Patrick F O'Reilly, III

(57) ABSTRACT

A temporarily mountable strip door system includes a strip mounting frame. The frame has mounting features to enable releasable coupling to an exterior of an opening in a building. A plurality of flexible door strips are affixed to the mounting frame. The system includes means for releasably affixing the mounting frame to the exterior of the opening. A method for controlling climate in a temporarily enclosed space include moving conditioned air from inside a device having a permanent heating, ventilation and air conditioning unit associated therewith through a duct into the temporarily enclosed space. Air is returned air from the temporarily enclosed space to the inside of the device.

24 Claims, 14 Drawing Sheets

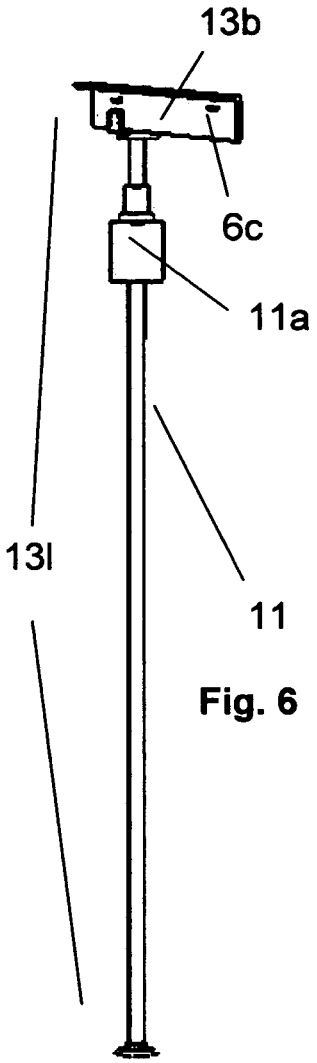
Fig. 6
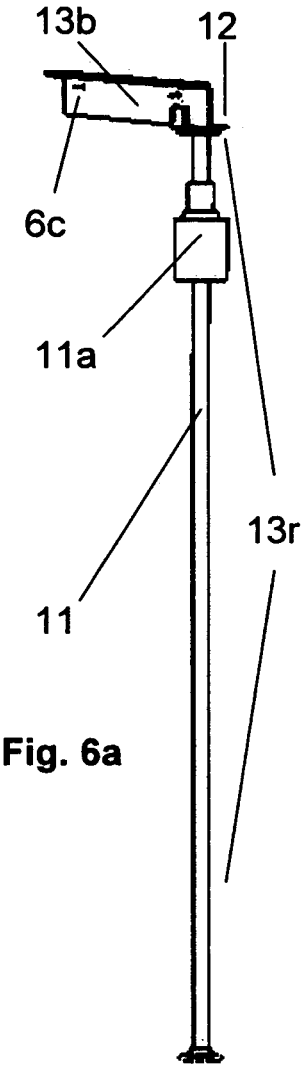
Fig. 6a
Fig. 7
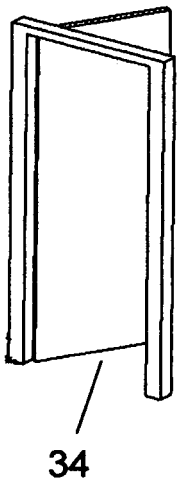
Fig. 7A
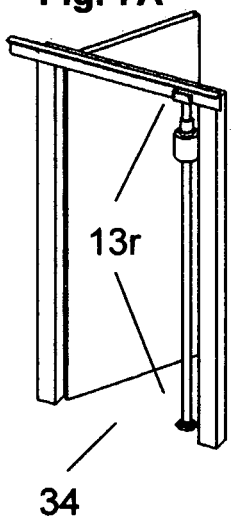
Fig. 7B
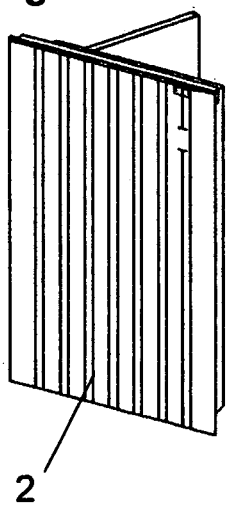

TEMPORARILY MOUNTABLE STRIP DOOR SYSTEM, ESPECIALLY FOR TEMPORARY CLIMATE CONTROL OF AN AREA

CROSS-REFERENCE TO RELATED APPLICATIONS

Priority is claimed from U.S. Provisional Applications No. 60/624,244 filed on Nov. 2, 2004 & No. 60/699,298 filed on Jul. 14, 2005

STATEMENT REGARDING FEDERALLY SPONSORED RESEARCH OR DEVELOPMENT

Not applicable.

BACKGROUND OF INVENTION

1. Field of the Invention

The invention relates generally to the field of flexible panel-type screens and enclosures. More specifically, the invention relates to methods and an apparatus for temporarily enclosing a space such that climate can be controlled in the temporarily enclosed space.

2. Background Art

A strip door is used to provide climate control in an enclosed area, yet allow free passage of humans, vehicles etc into and out of the enclosed area. A strip door is typically formed from a plurality of flexible plastic strips suspended from a mounting device secured to an upper edge of the opening to be sealed by the strip door. The strips may be formed from clear vinyl to enable visibility therethrough.

Strip doors are most commonly used where a great amount of such passage occurs, and where such passage would require that any other type of door be completely opened to effect such passage. In such cases using any other type of door, the cooling/heating systems used to maintain the selected interior climate either would be inadequate to handle the loss/gain in temperature, or such systems would have to be substantially oversized. Typical applications for strip doors include commercial enclosures such as refrigeration docks, air conditioned warehouses, manufacturing facilities where climates are different in different areas due to process requirements, etc.

Prior art strip doors generally have robust design and permanence of the installations. U.S. Pat. No. 3,331,425 to Groves et al. shows a robust, but complicated, high-cost strip door installation which allows for vehicle passage. The strip door attachment means shown in the '425 patent though automated, is not easily installed in a garage or temporary structure location. U.S. Pat. No. 3,809,144 to Garufo discloses strip door means customized for use in conjunction with aircraft hangers. U.S. Pat. No. 4,232,725 to Gidge shows another complicated strip door mounting device which includes many parts, thus making impractical to install and remove in short order. The door shown in the '725 patent focuses on energy efficiencies, vehicular passage and wind concerns. All the foregoing prior art strip door installation means do not allow flexibility in installation and removal and are relatively costly to make.

Typical strip doors known in the art are not adapted for completely temporary installation. It is desirable to have a strip door that could easily be loaded onto a delivery truck along with other temporary structures, for example, "moon walk" or similar portable, inflatable entertainment devices, and that could be used to enable otherwise non-climate controlled spaces such as residential garages to be used as climate-controlled rooms during an event of temporary duration. Using temporarily enclosed spaces in structures built to withstand inclement weather conditions can be far superior to air conditioned tents or the like and can be provided at a considerably lower cost.

Portable blower and conduit means for temporary rerouting of heating, ventilation and air conditioning ("HVAC") are used to provide climate control in enclosed areas such as construction sites, commercial structures under modification, hospitals which may have temporary outages of HVAC and the like. Such portable blower and conduit means, however, are not known to be used as temporary HVAC rerouting inside a permanent structure. It is desirable to have temporary rerouting of HVAC using such blower and conduit means to provide temporary HVAC within certain portions of permanent structures that do not require HVAC all the time. As a specific example, a room such as a residential garage, where HVAC climate control is not ordinarily provided, could be used as a temporary extra room. In such cases, where the garage is so used, it would be desirable to have climate control. An additional, portable HVAC unit could be provided, but such unit would incur additional expense. There is a need to be able to use the HVAC system in the part of the permanent structure having such HVAC system to provide climate control in a temporarily enclosed room within such permanent structure.

Temporarily erected structures, such as tents, may be provided with temporary HVAC climate control. Climate control for such structures known in the art is typically provided by a HVAC unit used for that specific purpose. Having such a separate HVAC unit can be costly, and can reduce extra carrying capacity of vehicles used to transport the structure to its location of use. What is needed is a device to enable climate control within temperary structure that can use a vehicular HVAC system for such purpose.

SUMMARY OF INVENTION

One aspect of the invention is a temporarily mountable strip door system. A door system according to this aspect of the invention includes a door strip mounting frame. The door strip mounting frame includes mounting features to enable releasable coupling to an exterior of an opening in a building. A plurality of flexible door strips are affixed to the door strip mounting frame. The strip door system includes means for releasably affixing the door strip mounting frame to the exterior of the opening.

Another aspect of the invention is a method for controlling the climate in a temporarily enclosed space. A method according to this aspect of the invention includes moving conditioned air from inside a device having a permanent heating, ventilation and air conditioning unit associated therewith through a duct into the temporarily enclosed space. Air is returned from the temporarily enclosed space to the inside of the device.

Other aspects and advantages of the invention will be apparent from the following description and the appended claims.

BRIEF DESCRIPTION OF DRAWINGS

FIGS. 6 and 6A show alternate temporary affixing device similar to that shown in FIG. 5, which uses a single hydraulic jack and cantilevered beam to support individual strip door panels.

FIGS. 7, 7A and 7B shows the affixing device from FIG. 6 mounted temporarily in front of a single-width pedestrian doorway.

DETAILED DESCRIPTION

The invention focuses the benefits of strip doors toward use in dwelling structures such as in homes, town homes, small offices, etc. Even high rise apartments and condominiums may find uses for temporary climate controlled areas where people/animals etc. can easily blend with the outdoors, yet have the comfort of an indoor, climate controlled space. A strip door system according to one aspect of the invention can easily be stored during times when the door system is not needed, and can be installed on a temporary basis when needed. In some embodiments, the temporary installation can be performed without any modification whatsoever to the structure to which the strip doors are installed. Furthermore, because the strip door installations are only temporary, the focus of climate control according to the various aspects of the invention is on making the temporary area comfortable, and the energy efficiency of climate control is only of secondary concern.

A strip door system according to the invention can also be decorated using designs such as can be painted, stenciled, etched, etc. onto the door strips themselves. The designs can flow continuously across the interfaces between the individual strips on each door panel. Such design makes the strip door usable as a decoration in addition to its climate barrier function.

Another aspect of the invention provides a very low cost means to expand the climate controlled area of a building. Additionally, in one aspect the invention adds no new HVAC equipment to the building and requires no additional electrical wiring other than what is in place in order to have climate control within an area not otherwise having climate control. Such features obviously reduce cost but also eliminate building code and architectural approval requirements that may be necessary for the addition of extra electrical/gas/power services and/or implementation of wall or window HVAC. Such services and HVAC units may not conform to some neighborhood deed restrictions, thus making the invention usable where more permanent installations may be contrary to such restrictions. In another embodiment of climate control according to this aspect of the invention, the passenger compartment of a motor vehicle having HVAC equipment therein can be used as a source of climate control for a temporarily enclosed space. As used in the description of this invention, the term "heating, ventilating and air conditioning unit" is intended to refer to any device that changes a characteristic of the air in an enclosed space, and includes, without limitation, devices such as heaters, air conditioners, dehumidifiers.

Figure 1:
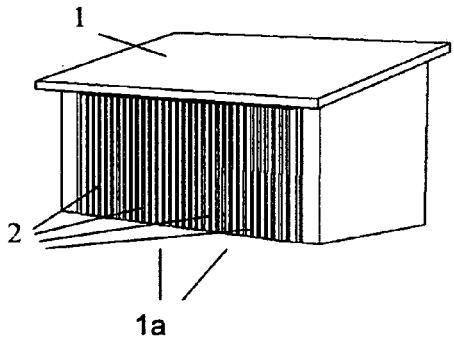
FIGS. 1A and 1 show a garage or storage enclosure having a temporary-installation strip door stored inside, then mounted temporarily for use as a temporarily enclosed room.
Figure 1A:
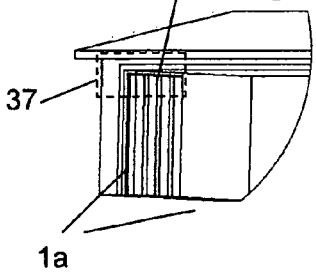

Having discussed the nature and applications of the various aspects of the invention, specific implementations will now be described to explain the principles by which the various aspects of the invention can be made and used. FIGS. 1 and 1A show an area 1 such as a garage, storage area or any other room forming a permanent part of a building, where the area 1 is ordinarily not provided with heating, ventilation and air conditioning (HVAC) equipment. The area 1 has an opening 1*a* to the out of doors that can accommodate a temporary door made of strip panels 2. The strip panels 2 are shown in FIG. 1A in a stored position on storage hooks 37 inside the area 1, which may he to one side of the opening 1*a* for convenience of use. The strip panels 2 then are shown in FIG. 1 mounted so as to cover the opening 1*a*. The strip panels 2 may subsequently be dismounted when the temporary use for the area 1 is completed. After dismounting the strip panels 2, as shown in FIG. 1A, stored away, the area 1 can be returned to its original use, for example, storage of autos when the area 1 is a garage. The strip panels 2 are shown again as stored in FIG. 1A. Thus, in a strip door system according to this aspect of the invention, the strip panels 2 are temporarily mounted to enclose the area 1 when required, and then the strip panels 2 are removed after the intended temporary use of the area 1 is completed. The strip panels 2 and the various forms of mounting thereof, which will be further explained below, are such that the mounting, dismounting and storage of the strip panels 2 can be repeated as often as necessary without any substantial modification to the building (exterior opening of the area 1) in which the area 1 is disposed.

Figure 2:
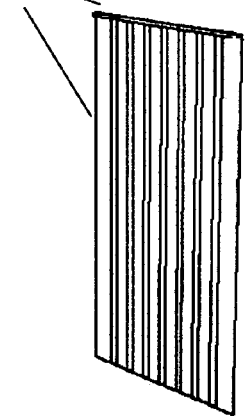
FIGS. 2, 2A, 2B, 2C and 2D show in detail one embodiment of a stand alone, modular strip door panel.
Figure 2A:
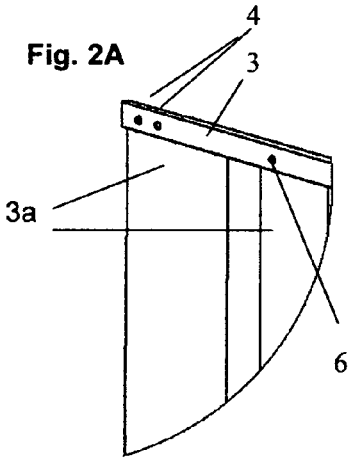
Figure 2B:
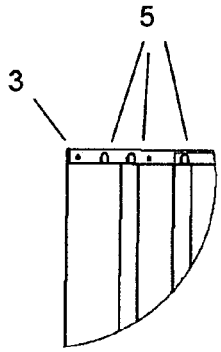

FIG. 2 shows one embodiment of the strip panel 2. FIG. 2A shows a primary mount for the panel 2 in the form of a channel 3, which may be made from a rigid, high strength material such as aluminum, steel or high impact plastic, which acts as mount for the panel's flexible door strips 3*a*. FIG. 2B shows one method of affixing the strips 3*a* in place on the channel 3 using indentations 5 in the channel 3 for crimping and holding. Plastic material to form the door strips 3*a* includes polyvinyl chloride (PVC), vinyl, or any other moldable, flexible plastic, and such materials are typically commercially available in 6-inch, 8-inch, 10-inch, and 12-inch widths, cut to a selected length to fit the particular opening (1*a* in FIG. 1). The strips 3*a* and can be ribbed, colored, etc. The panels 2, however, should be limited in channel length and resulting number of strips so as to be easily movable by one person. The current embodiment uses eight such strips, 3*a*, each approximately eight inches wide and approximately seven feet long. Seven feet is a typical garage door opening height. The panel 2 in the present embodiment can be approximately fifty inches wide, which provides for an overlap of 2 inches per strip 3*a*. Four of the panels 2 will then span a typical two-car garage opening, which typically is about sixteen feet horizontal dimension. The panels 2 can be configured differently with respect to strip length or number of strips (and corresponding channel length), as particular applications may require, such as for openings other than a garage door. Examples of such applications include a porch, or single pedestrian door etc.

Figure 2D:
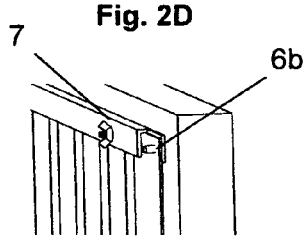
Figure 2C:
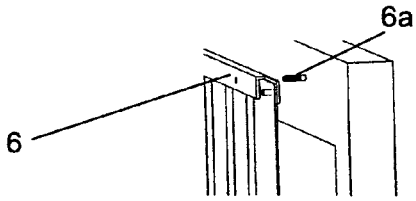

FIGS. 2C and 2D show one embodiment of mounting the panels 2 wherein through holes 6 are formed in the channel 3, which then slide over hanger bolts 6*a* affixed to the front of the frame surrounding the opening 1*a*. FIG. 2D shows a panel 2 slid in position and secured by a wing nut 7 at one of its hanger bolt locations. Optional overlap/locking means may he used as some holes 4 can overlap a protruding boss 6*b*. The present embodiment has mounting holes 6 on 32 inch centers, 9 inches from each end of the channel 3 to serve for a fairly balanced load distribution, but also to allow for storage hooks 37 to find studs on the room's 1 inner wall, which are typically on 16 inch centers. Such centers which will conform to the 32 inch centers of the mounting holes 6. The present embodiment also includes an extra hole located about 24 inches from one of the 32 inch center mounting holes 6 to accommodate lighter duty building construction where framing studs are located on 24 inch centers. Thus, in some embodiments, the mounting holes 6 are located such that the panels 2 can be temporarily mounted in the opening for their temporary use, and may be conveniently hung for storage when not in use.

Figure 3:
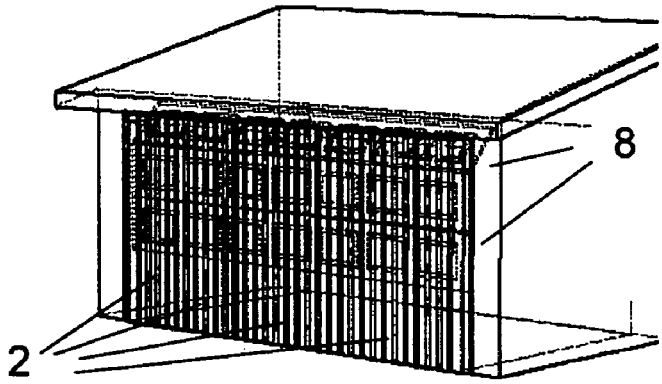
FIG. 3 shows a garage with the modular strip door panel mounted in front demonstrating the ability to close the permanent garage door located behind the strip door panel.

FIG. 3 shows one embodiment of a flush mount design described above that allows for closure of the garage or room door 8. Such mounting allows for temporary closure of the door 8 after periods of high pedestrian passage, thus allowing the climate control system (explained further below) to recover, if required. It also allows for temporary protection from high winds and rains if a storm or the like should pass through while the area 1 is being used for its temporary purpose.

Figure 4:
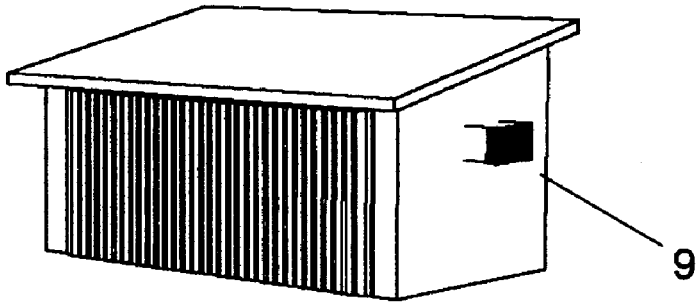
FIGS. 4 and 4A show a view of a garage or storage enclosure having different locations for HVAC units.
Figure 4A:
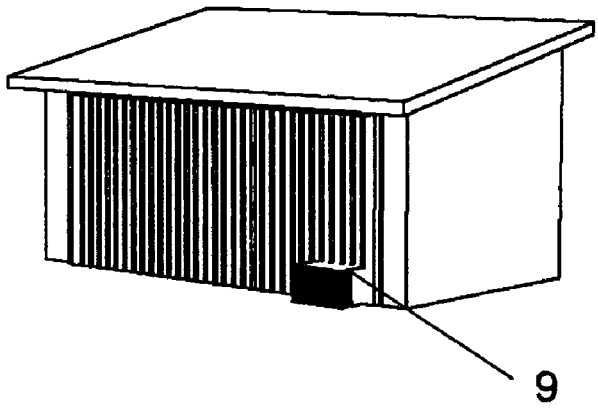

FIG. 4 shows a typical mounting of an HVAC unit 9 such as a window or wall-mount air conditioner, should the room 1 not be equipped with climate control. FIG. 4A shows an alternate location where the HVAC unit 9 can protrude through a passage in one of the panels formed by having its strips either cut or rolled up in a fashion so as to seal around the HVAC unit 9. This would be beneficial for interconnected buildings such as town homes where an outer wall for thermal exchange may not be accessible.

Figure 5:
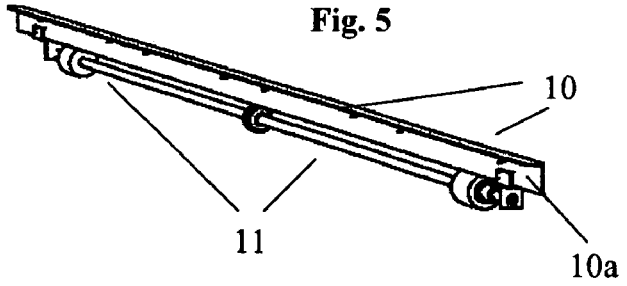
FIGS. 5, 5A, 5B, 5C and 5D include views of a method and device to temporarily affix strip door panels in front of a permanent door without having any permanently affixed mounting device in the permanent structure.
Figure 5A:
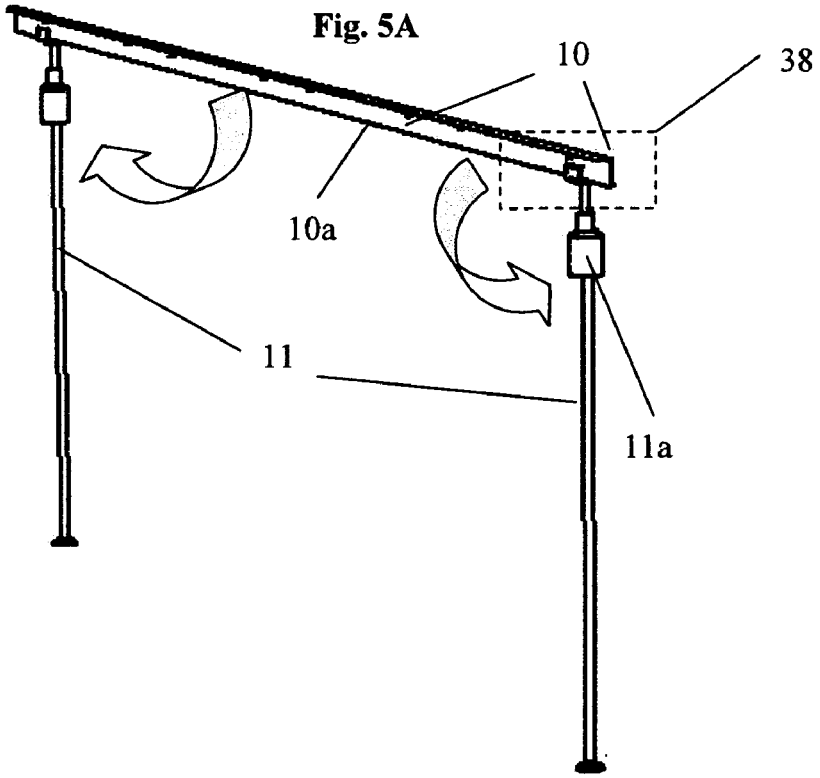
Figure 5B:
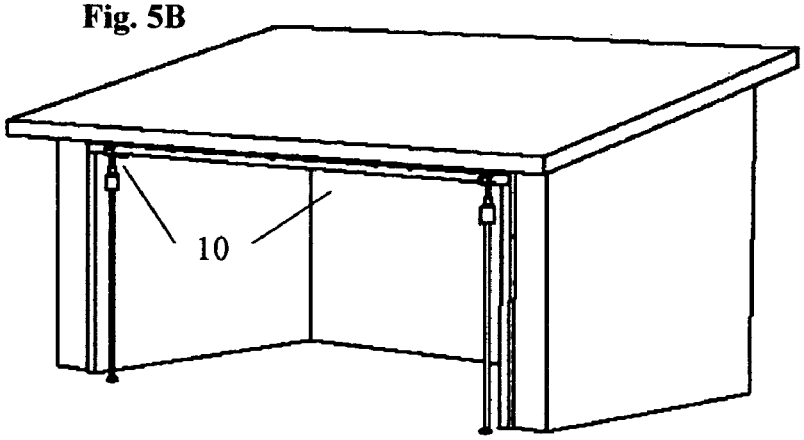
Figure 5C:
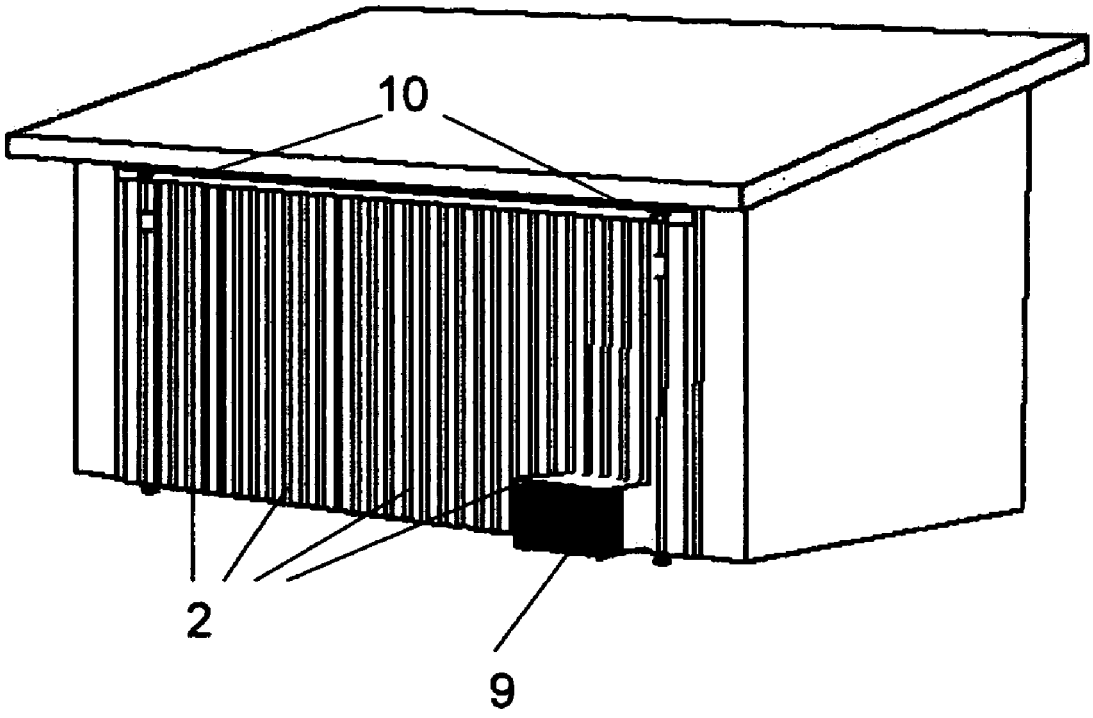
Figure 5D:
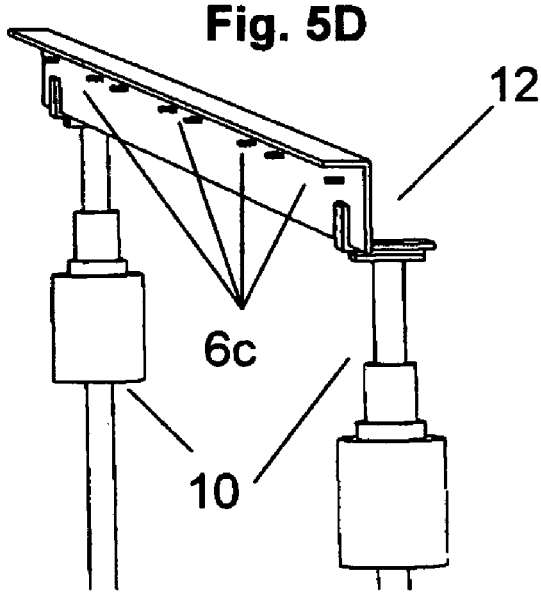

FIG. 5 shows an alternative form of temporary mounting that requires no modifications to the building of any kinds, including a frame 10 consisting of a beam 1O*a* and mounting, jacking poles 11 shown in a collapsed position best for transportation and storage. FIG. 5A shows the jacking poles 11, with pivotal mounts on the top end 38, pivoted out to position for affixing to the door frame. The length of the beam 10*a* and the height of the jacking poles 11 can be selected to match a typical 16 foot wide, 7 foot high door opening, however the beam 10*a* and jacking poles 11 can be sized for most any door width, with a beam strength sufficient to hold the loads of a plurality of panels 2. A jack 11*a*, such as a screw jack, hydraulic jack or the like can be mounted or contact part of the jacking poles 11 as shown in FIG. 5A. FIG. 5B shows the temporary frame 10 of FIG. 5A placed in front of the door opening to accommodate the temporary climate barrier made of one or more panels (2 in FIG. 1). FIG. 5D shows a view of the frame 10 including a ledge 12 by which the jack 11*a* puts the poles 11 and beam 10*a* into compression between the floor and the garage or room door's frame. The ledge 12 is rigidly connected to or forms a part of the mounting beam 10*a*, and all loads to the beam 1O*a* transfer through it. The area of contact between the beam 1O*a* and the door opening is typically protected with a scratch resistant material and/or soft material shims (not shown) are placed between the beam 10*a* and the opening to assure no damage or scoring to the garage or room door frame. The shims can also act as a means to adjust the standard door height slightly to accommodate different ways in which doors are coped in, and to maintain the best coverage of the opening by the temporary strip door. The frictional and compressional load on the poles 11 when mounted as shown in FIG. 5B keep the poles 11 in place as though they were permanent column structures. In FIG. 5D, flush mount threaded studs 6*c* can be press fit or welded to the beam 10*a* to provide a mounting means for the panels 2 similar to that explained above with reference to FIG. 2B. FIG. 5C shows the panels 2 affixed to the temporary frame and a portable HVAC unit 9, such as a wall mount air conditioner protruding through the temporary climate barrier for thermal exchange.

FIG. 6 and FIG. 6A show alternate embodiments of left-handed and right-handed temporary mourning frames 131, 13*r*. Such mounting frames 131, 13*r* can include a cantilever beam 13*b* utilizing jacking poles 11, a jack 11*a*, a rigidly connected or integrally formed ledge 12, and threaded studs 6*c*, as explained above with reference to FIGS. 5-5D). These mounting frames 131, 13*r* can be fabricated for placing the jack 11*a* to the left or to the right for reasons shown in following figures. The ledge 12 and/or mounting studs 6*c* may also be placed slightly off of perpendicular to vertical to allow for slight flexure of the beam and still allow for level mounting of the panels (2 in FIG. 1).

FIG. 7 shows an individual pedestrian door passage 34. Such a passage is typically connected to a garage or similar area to be temporarily climate controlled. FIG. 7A shows a temporary frame 13*r* jacked into position with the jacking pole 11 to one side of the passage 34, allowing for an adequate pedestrian passageway. FIG. 7B shows a panel 2, affixed to the mounting frame 13*r*, thus creating a see though, walk through climate barrier for the individual passage 34 now blocked from view.

Figure 8:
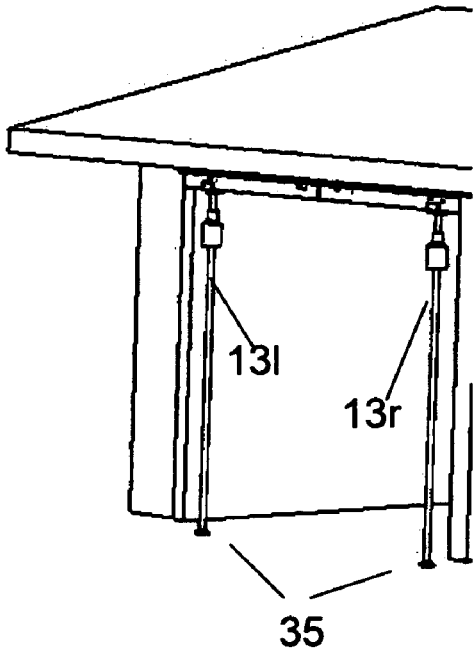
FIGS. 8 and 8A show a plurality of the devices shown in FIG. 6 mounted temporarily in front of a single-car garage doorway.
Figure 8A:
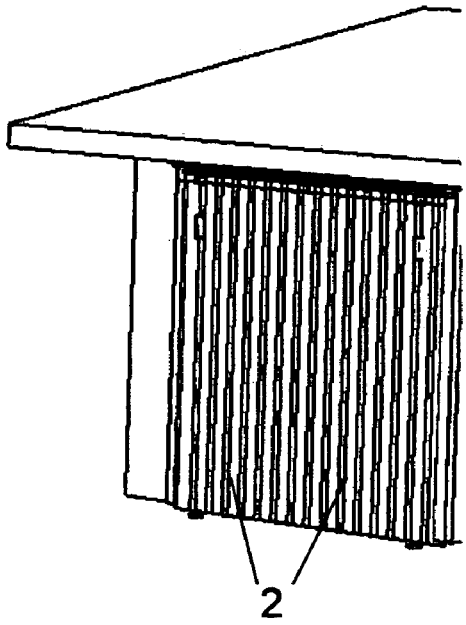

FIG. 8 shows a single garage door opening 35 with both a left 131 and right 13*r* temporary mounting frame spanning the complete opening. FIG. 8A shows panels 2 affixed to the temporary mounting frames creating a walk-through climate barrier, with no obstruction in the middle thereof.

Figure 9:
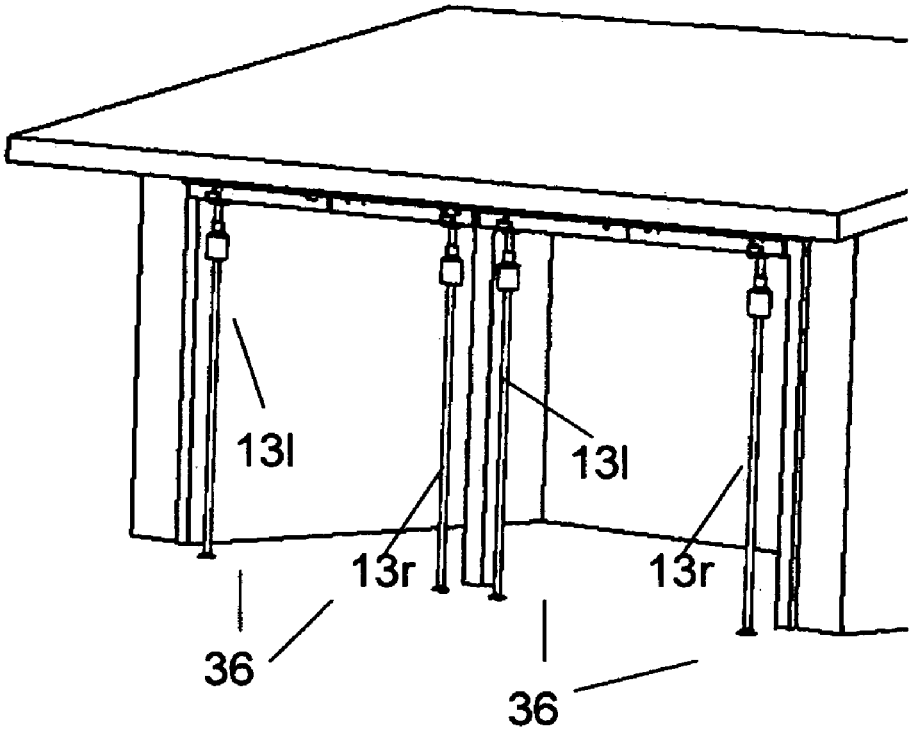
FIGS. 9 and 9A show a larger number of the devices shown in FIG. 6 mounted temporarily in front of a two car garage.
Figure 9A:
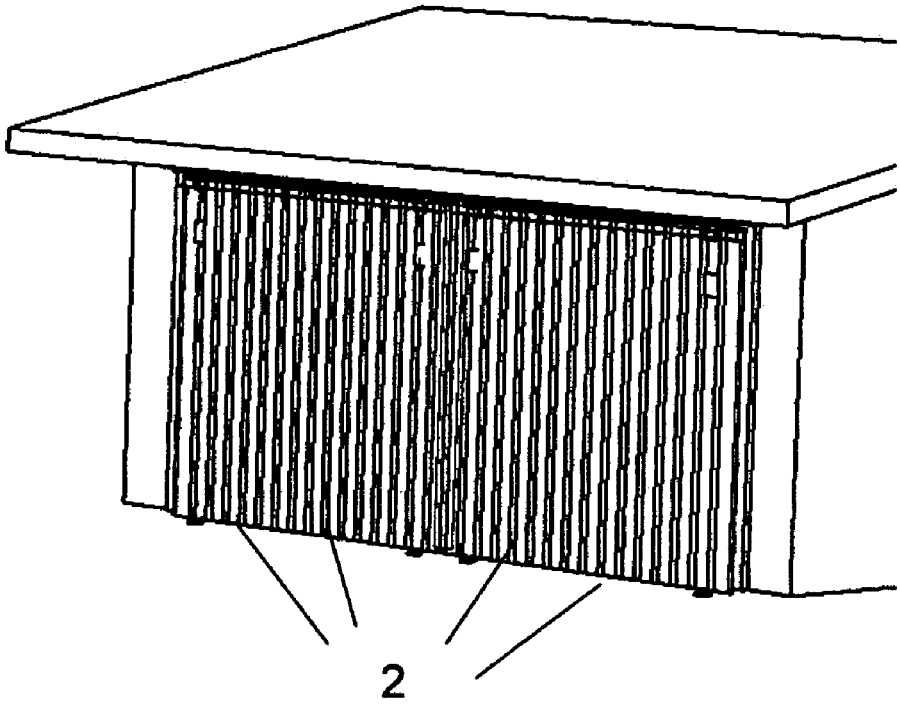

FIGS. 9 and 9A show a double garage which utilizes two single garage door openings 36. Two left 131 and two right 13*r* temporary mount frames are utilized to create a plurality of strip door passageways as described above with reference to FIG. 8.

FIG. 9A shows the two openings 36 with panels 2 mounted. Areas of FIGS. 8A and 9A can easily then be climate controlled using a portable HVAC unit as described above with reference to FIG. 5C. It will be apparent to one skilled in the art that the advantages of making a strip door from one or more personally transportable panels include flexibility to match most any opening size. The system described above with reference to FIGS. 8 to 9A perform the same basic climate control function as the system in FIGS. 5, 5A and 5B. The advantages of the system shown in FIGS. 8 through 9A may include compact size of the components, ease of shipment, ease of set up and ease of storage, among others.

Figure 10:
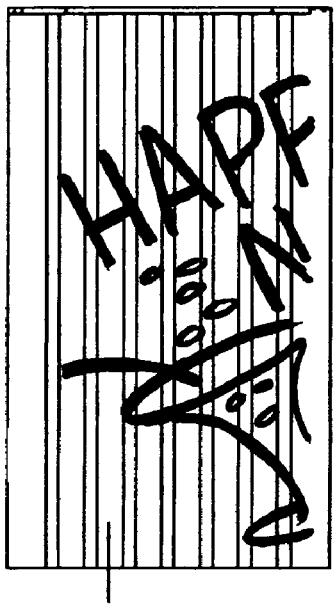
FIGS. 10, 10A, 10B, 10C and 10D show examples of overlapping decorated modular strip door panels.
Figure 10A:
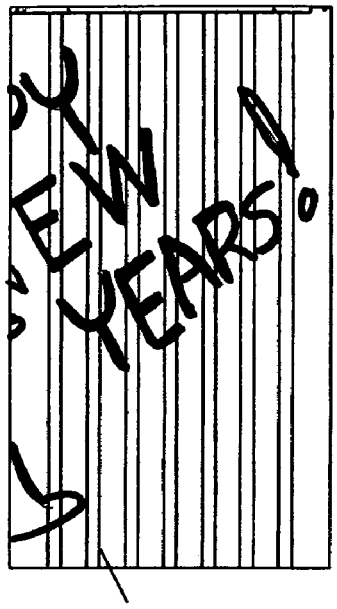
Figure 10B:
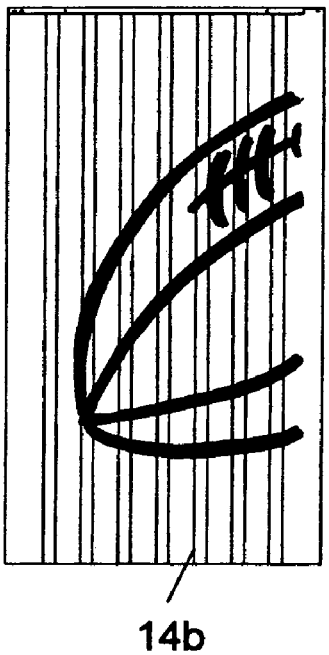
Figure 10C:
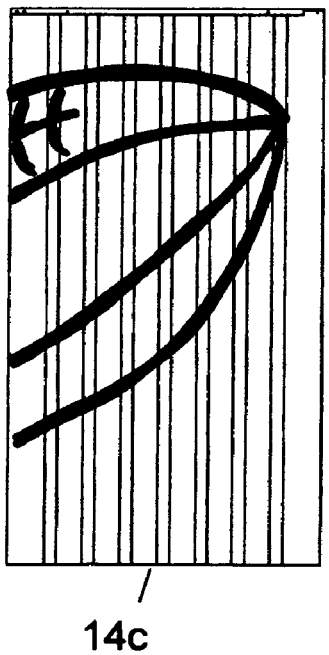
Figure 10D:
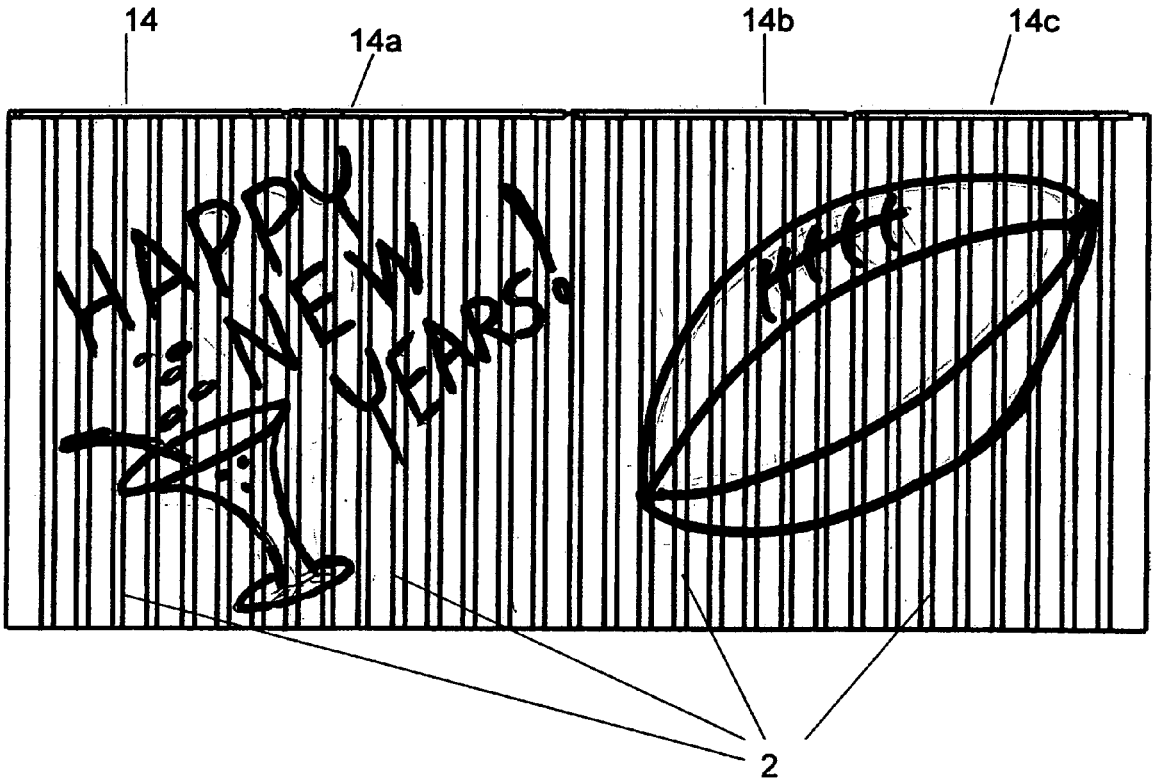

FIGS. 10, 10A, 10B, 10C show design panels 14, 14*a*, 14*b* and 14*c* which can add character of individuality to the strip door. FIG. 10D shows panels assembled with the design portions mating up. The designs can be painted, stenciled, decaled etc. onto the strips (3*a*in FIG. 2A).

Figure 11:
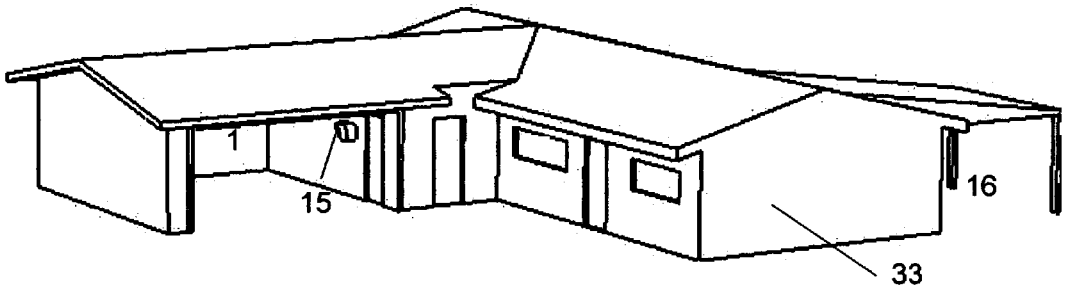
FIGS. 11 and 11A show an isometric view of a typical house with a garage and a covered back porch, both porch and garage being equipped with temporary climate control means.

Another aspect of the invention will now be explained with reference to FIGS. 11 and 11A, which show an isometric view of a typical dwelling structure such as a home 33 that has a garage area 1 and a covered back porch 16. The home has temporary air moving devices powered by blowers 15 shown in the garage 1 in FIG. 11, and in FIG. 11 A, in the area of the back porch 16. In FIGS. 11 and 11 A, the blower driven mixing systems are not being used and the ducting systems are blocked with a louver or cover of some form so as to contain the conditioned air to the main section of the home.

Figure 11A:
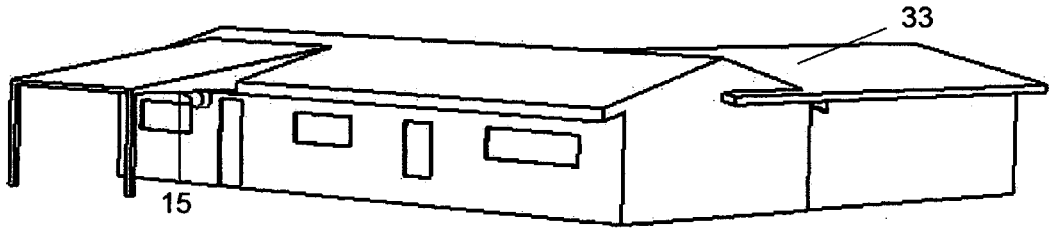
Figure 12:
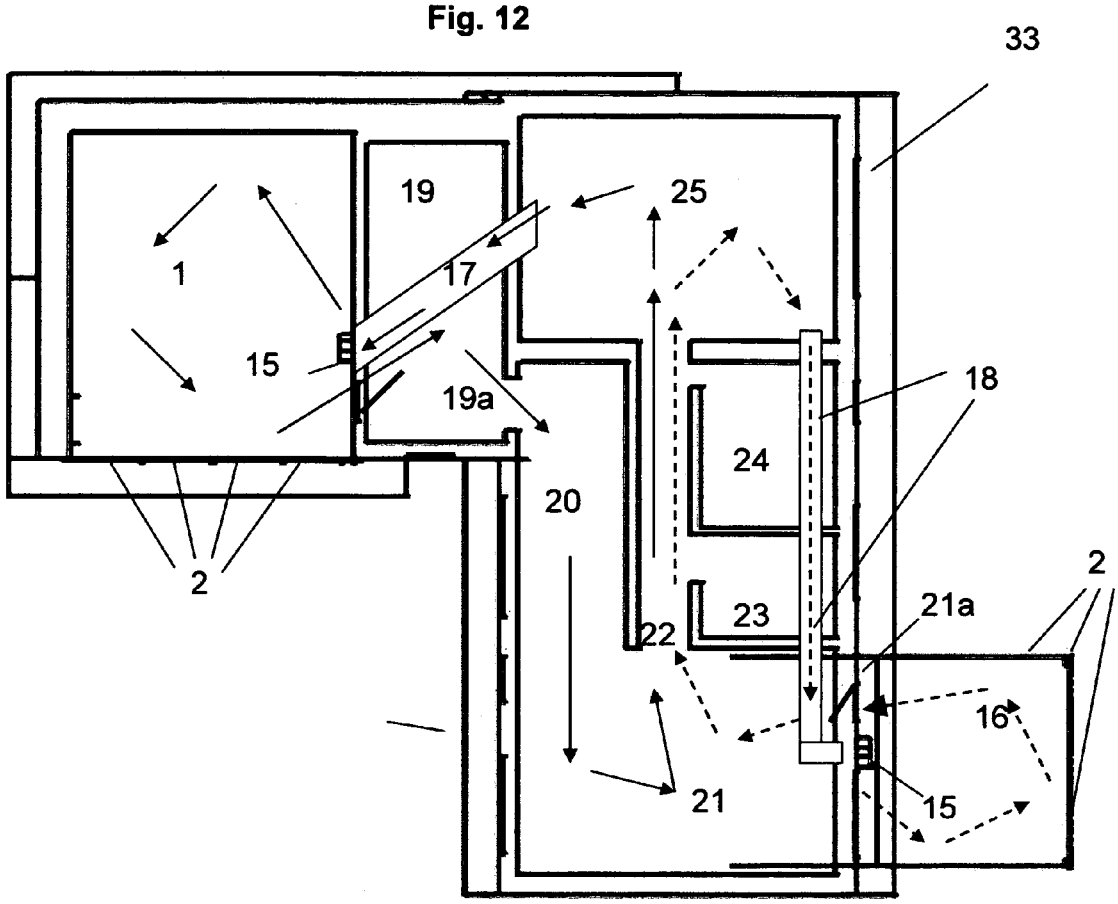
FIG. 12 is a basic floor plan of the house shown in FIGS. 11 & 11A, showing the main rooms (small rooms such as baths and closets omitted) and describes the temporary circulation paths for climate control.
Figure 13:
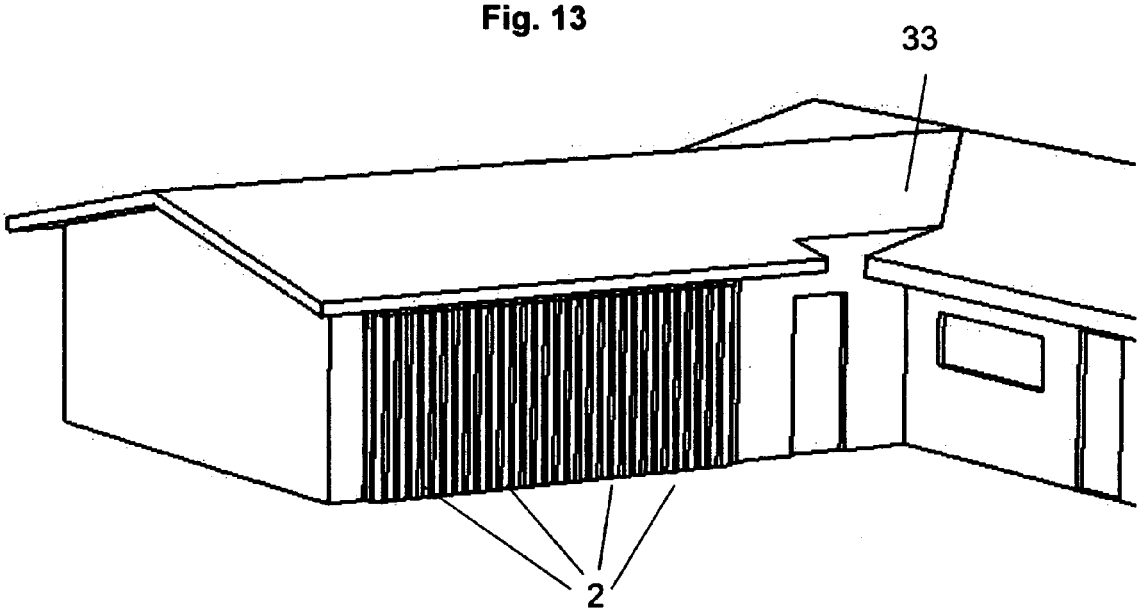
FIG. 13 shows the garage from FIGS. 11 and 11A closed in with temporary panel means.

FIG. 12 is a floor plan view of the home 33 in FIGS. 11 & 11A. FIG. 12 shows a garage 1, kitchen area 19, entry 20, living room 21, hallway 22, bedrooms 23, 24 and master bedroom 25. Two large bypass ducts 17, 18 are used to source conditioned air (controlled by the home's HVAC system to be cool, warm, humidity adjusted etc.) from the master bedroom 25 area. The duets 17, 18 may be muted through the attic of the home, may he in furrowed areas just below the ceiling, or may be routed in any other fashion which may meet the level of aesthetics required by the user. The reason that the ducts 17, 18 are routed to the master bedroom 25 in this embodiment is that such routing creates the longest mixing path for the air and maximizes the source benefit that the HVAC conditioned home has to offer. HVAC sourcing from the home 33 may be to any room, however it is best to make the air circulation path as long as possible through the climate controlled area of the home. When the bypass duct 17 is being used to circulate air though the garage 1, the solid arrows show the path of the airflow. When bypass duct 18 is being used to circulate air though the porch 16, the dashed arrows show the path of the airflow. In the present embodiment, the garage 1 or the porch 16 can be isolated from the outdoors using strip doors substantially as explained above. FIG. 13, for example, shows the garage area of a home 33, contained by the temporary panels 2 as was described in FIG. 1.

The blower 15 is turned on and the louver or cover inside of the bypass duct 17 is opened or automatically opens. Simple opening of the kitchen door 19*a* (FIG. 12) allows return air to flow back through the home and be conditioned rapidly as it passes through the already conditioned air and again returns to the garage 1.

Figure 14:
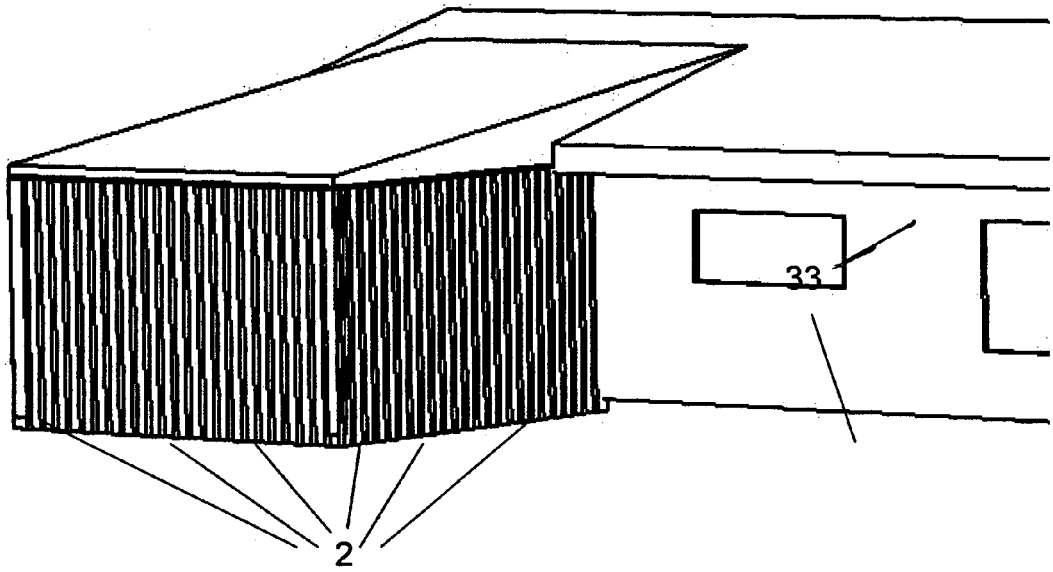
FIG. 14 shows the back porch of the house of FIGS. 11 and 11A closed in with temporary panel means.

FIG. 14 is similar to FIG. 13. FIG. 14 shows the porch area of a home 33, enclosed by the strip door panels 2. The blower 15 is turned on and the louver means inside of the bypass duct 18 is opened or automatically opens. Simple opening of the living room door 21*a* (FIG. 12) allows return air to flow back through the house and be conditioned rapidly as it passes through the already conditioned air and again returns to the porch 16.

FIGS. 13 and 14 are shown separately as typical home HVAC systems do not have excess capacity to condition more than one temporary area at a time, however, if the concept were planned in the initial stages of construction, ample HVAC capacity could be provided to condition both temporarily enclosed areas (porch 16 and garage 1) simultaneously.

Figure 15:
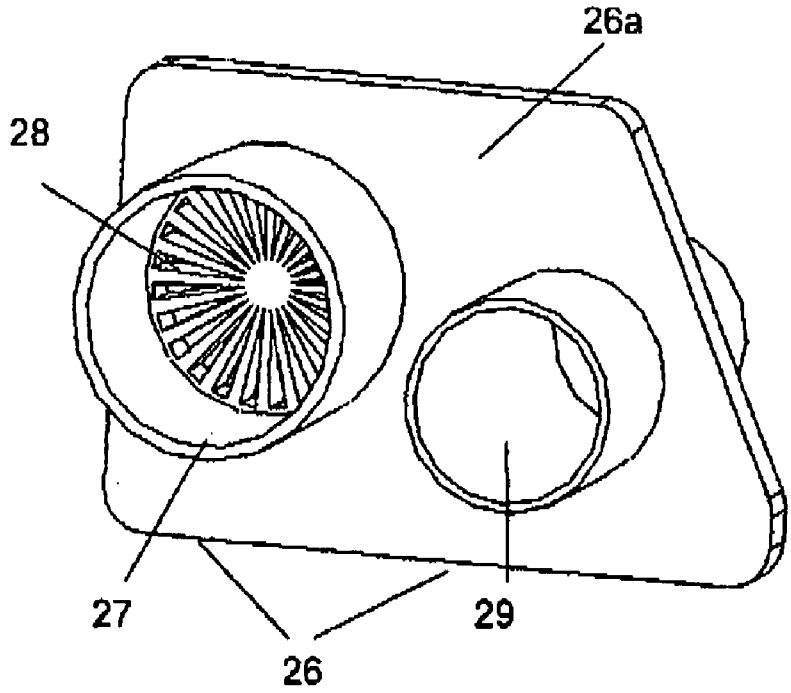
FIG. 15 shows a climate exchange device consisting of a fan, return duct and conforming window mount, which uses a vehicle HVAC device for climate control.

FIG. 15 shows a climate exchange means 26 consisting of a fan 28 encased in a duct 27, with a return duct 29, and a conforming window mount 26*a*. The fan 28 is preferably a high volume fan, powered typically by a 12 volt motor. The motor may include a power connector to enable drawing power from an automobile cigarette lighter outlet or the like. Ducts 27, 29 are short for low pressure loss, and need only be long enough to span from a parked motor vehicle to a temporary enclosure. The window mount 26*a* can be fabricated out of thin gauge sheet metal and wrapped with a thick foam insulator that can conform to most any vehicle window.

Figure 16:
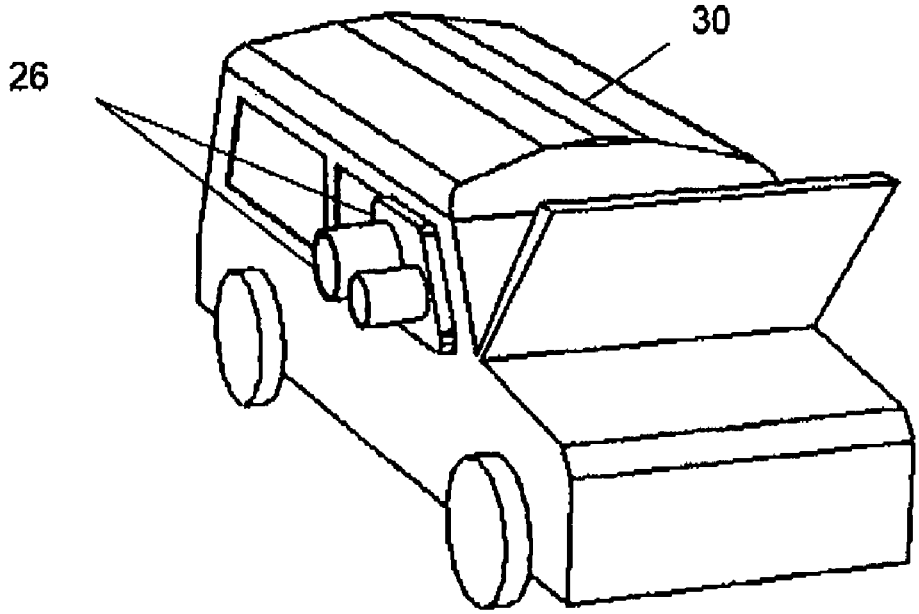
FIG. 16 shows the device from FIG. 15 mounted in a window of a parked vehicle with its hood up allowing for additional engine cooling.

FIG. 16 shows the climate exchange means 26 of FIG. 15 mounted in a window of a parked vehicle 30. This is done simply by lowering the vehicle window, inserting the exchange means 26, then partially closing the window so the foam insulator conforms to the window opening geometry and seals the internal passenger compartment of the vehicle 30. The vehicle 30 is parked with safety brake on, and its hood is lifted for additional engine cooling lessening the chance of overheating the vehicle engine. This would not, however, be of concern for heating applications of the concept, as in cold weather, the engine should retain heat to operate optimally, and thus the hood would typically be closed.

Figure 17:
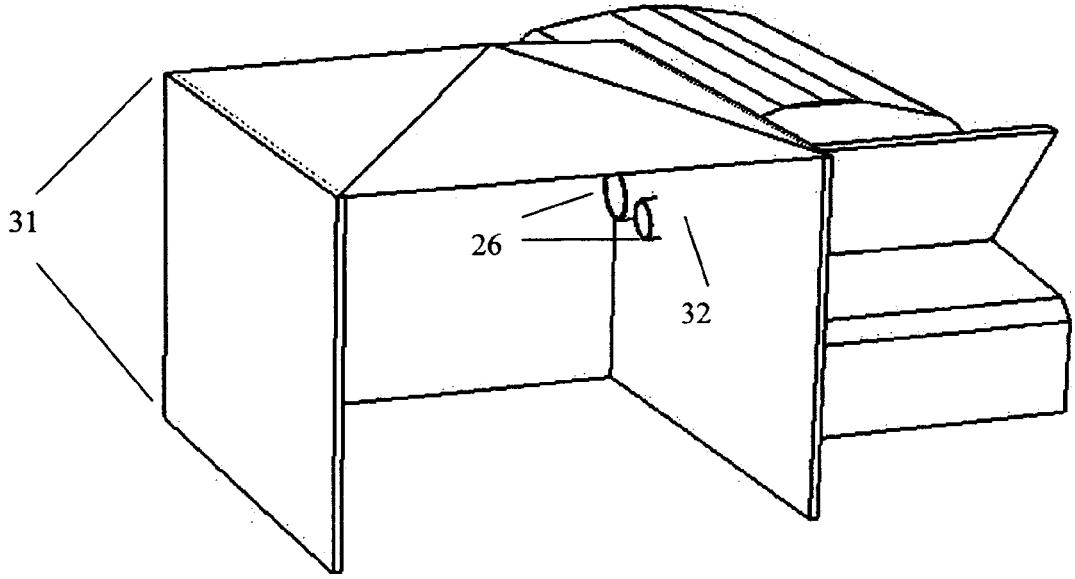
FIG. 17 shows a three sided/roofed tent positioned next to the vehicle from FIG. 16 having one of its three panels perforated to conform to the climate exchange device.

FIG. 17 shows the next step in the set up, where a three sided/roofed tent 31 is positioned next to the vehicle 30 of FIG. 16. One of the tent's 31 three panels is perforated 32 to conform to the climate exchange means 26. It is preferred that the perforations are to the back of the tent 31 which then will make the tent position to the front, safely away from vehicle exhaust.

Figure 18:
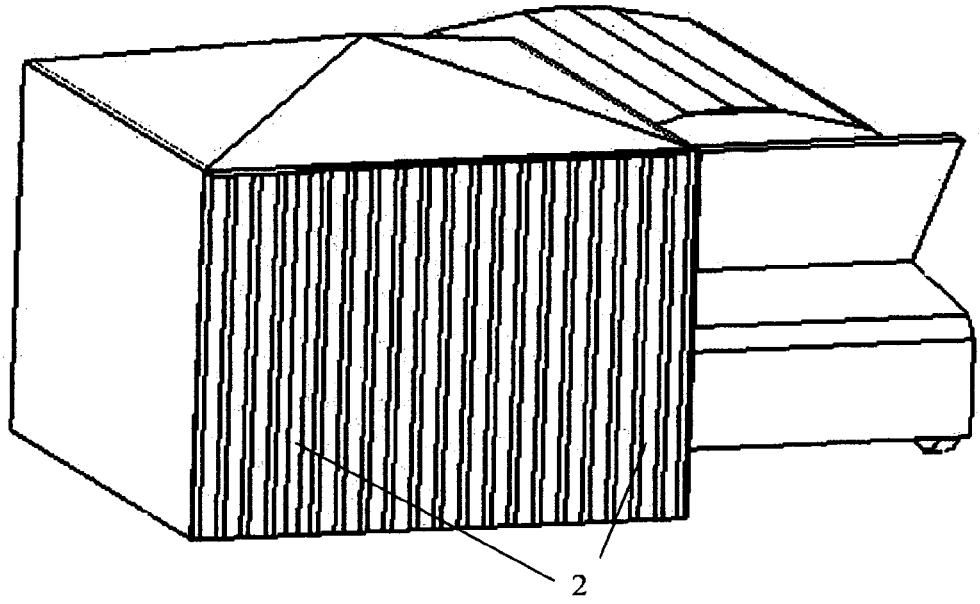
FIG. 18 shows the front side of the tent equipped with walk-through climate barrier strip door.

FIG. 18 shows the front side of the tent equipped with the walk through climate barrier panel 2 explained above with reference to FIG. 1. The air conditioning or beating system in the vehicle (30 in FIG. 16) is turned on, with the vehicle engine as its regular power source. The fan 28 is plugged into the 12 volt power outlet (cigarette lighter outlet or similar) and die now enclosed tent 31 will be climate controlled as an extension of the vehicle's air conditioning or heating. Though the foregoing system is not thermally efficient, the system can greatly improve the climate in the temporarily enclosed area. The system of FIG. 18 also allows for pedestrian passage in/out of the climate controlled area where those inside have full view of the outside.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A temporarily mountable strip door system, comprising:

a strip panel door configured to be moved from a stored position to a mounted position; a primary mount, the primary mount having holes to enable releasable coupling to an exterior of an opening in a building; a plurality of flexible door strips affixed to the primary mount creating the strip panel door; means for releasable mounting of the strip panel door in the form of at least one of hanger bolts, studs and wing nuts; exterior of an opening when the strip panel door is in the mounted position; means for storing the strip panel door in the form of storage hooks; mounting means affixed to the opening in a building conforming to holes in the primary mount; the primary mount having holes on 32 inch centers which slide over the mounting means affixed to the opening; holes conforming to storage hooks for stored position, the primary mount having at least one extra hole to conform to alternate storage hook location and where the at least one extra hole is on a 24 inch center with respect to one of the holes on 32 inch centers.

2. The door system of claim 1 wherein at least one of the plurality of door strips comprises a decoration thereon.

3. The door system of claim 2 wherein a decoration on at least two of the door strips cooperate to form a composite decoration.

4. The door system of claim 1 further comprising a portable heating, ventilating and air conditioning unit, and wherein at least one of the door strips has a length selected to provide through access for the heating ventilating and air conditioning unit.

5. The door system of claim 1 further comprising at least one duct disposed at one end within an interior space enclosed by the mounting frame and door strips, the at least one duct extending into a climate controlled space within a device proximate the enclosed space, and a blower coupled to an end of the at least one duct disposed within the climate controlled space.

6. The door system of claim 5 further comprising a return duct disposed at one end within the enclosed space and at another end within the climate controlled space.

7. The door system of claim 5 wherein the climate controlled space comprises an interior of a dwelling structure.

8. The door system of claim 1 wherein the holes of the mounting frame are spaced at at least one of 16, 24 and 32 inches apart from each other.

9. The door system of claim 1 wherein the opening of the building comprises a garage door.

10. The door system of claim 9 wherein the garage door closes behind the strip panels when in the mounted position.

11. The door system of claim 1 wherein the opening of the building comprises a porch.

12. The door system of claim 1 wherein the opening of the building comprises an open side of a sided/roofed tent.

13. The door system of claim 1 wherein the means for storing the strip panel door keeps the strip panel door in a vertical position during storage.

14. A temporarily mountable strip door system, comprising: a strip panel door configured to be disposed in a mounted position; a primary mount, having holes to enable releasable coupling thereof to a frame; a plurality of flexible door strips affixed to the primary mount thereby creating the strip panel door; means for releasable mounting of the strip panel door to the frame, wherein the frame includes a beam with at least one mounting and jacking pole, wherein the at least one jacking pole has a top end and the at least one jacking pole is pivotally mounted to the beam at the top end thereof and the at least one jacking pole has both a pivoted in and pivoted out position; means for affixing frame to a door opening including at least one jacking pole in the pivoted out of position; frame including a ledge and wherein the beam includes at least one device to suspend the strip panel door therefrom.

15. The door system of claim 14 wherein at least one of the plurality of door strips comprises a decoration thereon.

16. The door system of claim 15 wherein a decoration on at least two of the door strips cooperates to form a composite decoration.

17. The door system of claim 14 further comprising a portable heating, ventilating and air conditioning unit, and wherein at least one of the door strips has a length selected to provide through access for the heating ventilating and air conditioning unit.

18. The door system of claim 14 further comprising at least one duct disposed at one end within an interior space enclosed by the mounting frame and door strips, the at least one duct extending into a climate controlled space within a device proximate the enclosed space, and a blower coupled to an end of the at least one duct disposed within the climate controlled space.

19. The door system of claim 18 further comprising a return duct disposed at one end within the enclosed space and at another end within the climate controlled space.

20. The door system of claim 19 wherein the climate controlled space comprises an interior of a dwelling structure.

21. The door system of claim 14 wherein the opening of the building comprises a garage door.

22. The door system of claim 21 wherein the garage door closes behind the strip panels when in the mounted position.

23. The door system of claim 14 wherein the opening of the building comprises a single-width pedestrian door.

24. The door system of claim 14 wherein the beam and at least one jacking poles are in single pairs of left handed and right handed configurations.

* * * * *